US005794833A

United States Patent [19]

Strååt

[11] Patent Number: 5,794,833

[45] Date of Patent: Aug. 18, 1998

[54] CASSETTE FOR USE IN A STAPLER

[75] Inventor: Olle Strååt, Hestra, Sweden

[73] Assignee: Isaberg AB, Hestra, Sweden

[21] Appl. No.: 318,602

[22] Filed: Oct. 6, 1994

[30] Foreign Application Priority Data

Apr. 16, 1992 [SE] Sweden ..... 9201230

[51] Int. Cl.[6] ..... B27F 9/21

[52] U.S. Cl. ..... 227/137; 227/82; 227/88; 227/170; 227/129

[58] Field of Search ..... 227/82, 83, 87, 227/88, 131, 137, 120, 124, 129, 135, 136

[56] References Cited

U.S. PATENT DOCUMENTS

| | | | |
|---|---|---|---|
| 4,570,841 | 2/1986 | Olesen | 227/95 |
| 4,573,625 | 3/1986 | Olesen et al. | 227/131 |
| 4,588,121 | 5/1986 | Olesen | 227/120 |
| 4,623,082 | 11/1986 | Kurosawa | 227/7 |
| 4,720,033 | 1/1988 | Olesen | 227/131 |
| 4,770,034 | 9/1988 | Titchener et al. | 73/151 |

FOREIGN PATENT DOCUMENTS 0 448 255 9/1991 European Pat. Off. .

0 366 094 6/1992 European Pat. Off. .

*Primary Examiner*—Rinaldi I. Rada
*Assistant Examiner*—Boyer Ashley
*Attorney, Agent, or Firm*—Shapiro and Shapiro

[57] ABSTRACT

A cassette (10*a*, 10*b*, 11), which contains juxtaposed wire staple blanks releasably interconnected to form at least one strip (8) of staple blanks, is adapted to be used in a stapler for driving staples into an object, such as a sheaf of papers. The stapler comprises a base and a stapler head movable in relation to the base. The cassette accommodates a reciprocating staple shaper (20), adapted to successively shape the staple blanks of the strip (8) into U-shaped staples, and a reciprocating staple driver (19), adapted to successively release the thus-formed staples from the strip (8) and drive them into an object. The cassette has a front wall (11) in which the staple shaper (20) and the staple driver (19) are displaceably guided, as well as recesses through which projections on the staple shaper and the staple driver project, so as to engage, when the cassette is mounted in the stapler head, a drive mechanism (4) arranged in the stapler head to reciprocate the staple shaper and the staple driver.

61 Claims, 5 Drawing Sheets

CASSETTE FOR USE IN A STAPLER

BACKGROUND OF THE INVENTION

The present invention relates to a cassette which contains juxtaposed wire staple blanks releasably interconnected to form at least one strip of staple blanks and which is adapted to be used in a stapler for driving staples into an object, such as a sheaf of papers, said stapler comprising a base, a stapler head movable in relation to the base, and a drive mechanism for reciprocating both a reciprocating staple shaper arranged to successively shape the staple blanks of the strip into substantially U-shaped staples, and a reciprocating staple driver arranged to successively release the thus-formed staples from the strip and drive them into an object.

Usually, conventional staplers have a base, a stapler head pivotably connected to the base, and a magazine arranged in the stapler head and containing U-shaped staples disposed close to one another in a long row. Naturally, the largest number of staples in the magazine may vary from one stapler to another, but generally is in the order of a few hundreds.

To increase the largest number of staples with which to charge the stapler, the magazine in electrically driven staplers, which are very common, has been replaced with a cassette containing juxtaposed wire staple blanks releasably interconnected to form at least one strip of staple blanks. When the staple blanks form several strips, these are comparatively short and in the form of plates stacked in the cassette. Also, the staple blanks may form a single long strip rolled up into a roll. Prior-art cassettes containing plates of staple blanks are disclosed in EP-A1-0 366 094 and U.S. Pat. No. 4,623,082, and prior-art cassettes containing a rolled-up strip of staple blanks are disclosed in U.S. Pat. No. 4,570,841, U.S. Pat. No. 4,573,625, U.S. Pat. No. 4,588,121, U.S. Pat. No. 4,720,033 and U.S. Pat. No. 4,770,334. Such a cassette may contain several thousands of staple blanks.

In much-used cassette-equipped staplers, the staple shaper, serving to shape the staple blanks into U-shaped staples, and the staple driver, serving to expel the U-shaped staples, are worn and have to be replaced after some time. To replace these components in the prior-art staplers is a very complicated operation and has to be performed by specially trained personnel. Another disadvantage of the known staplers is that it is sometimes necessary to send for trained personnel to dislodge a staple that is stuck in the stapler. This is so because it is difficult to get at the stuck staple, which sometimes may only be removed after the dismounting of certain stapler components, such as the staple shaper and the staple driver.

SUMMARY OF THE INVENTION

Generally, an object of the present invention is to provide a cassette-equipped stapler obviating the drawbacks mentioned above. A more specific object of the invention is to provide a cassette making it possible to readily replace the staple shaper and the staple driver as well as take care of stoppages caused by a staple stuck in the stapler.

According to the invention, these object are achieved by a cassette which is of the type mentioned by way of introduction and which is characterised in that it accommodates the staple shaper and the staple driver, that it has a front wall in which the staple shaper and the staple driver are displaceably guided, as well as recesses through which projections on the staple shaper and the staple driver project, and that it is designed to be so mounted in the stapler head that the staple shaper and the staple driver with their projections engage the drive mechanism to be reciprocated thereby.

Being provided in the cassette, the staple shaper and the staple driver are readily replaced every time a new cassette is inserted in the stapler. A stoppage caused by a stuck staple is easily taken care of by exposing the location of the stuck staple by removing the cassette from the stapler.

In a preferred embodiment, the cassette is composed of a casing in which the strip is provided and which has a front opening for discharging the strip, and a front plate which forms the front wall and is releasably attached to the casing over the discharge opening and which has, in the side facing the casing, means for guiding the staple shaper and the staple driver.

BRIEF DESCRIPTION OF THE DRAWINGS

The invention will be described in more detail below with reference to the accompanying drawings, in which.

DESCRIPTION OF THE PREFERRED EMBODIMENT

Figure 1:
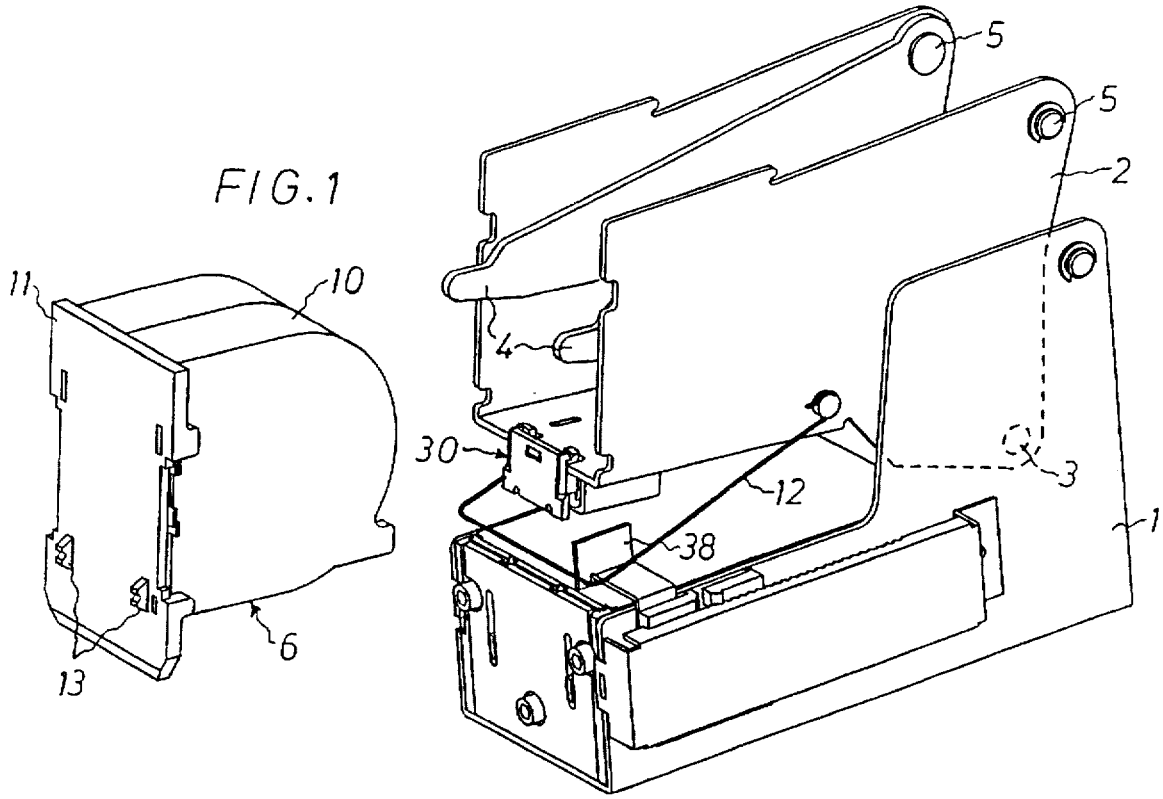
FIG. 1 is a perspective view of an electric stapler and an inventive cassette shown separately.
Figure 2:
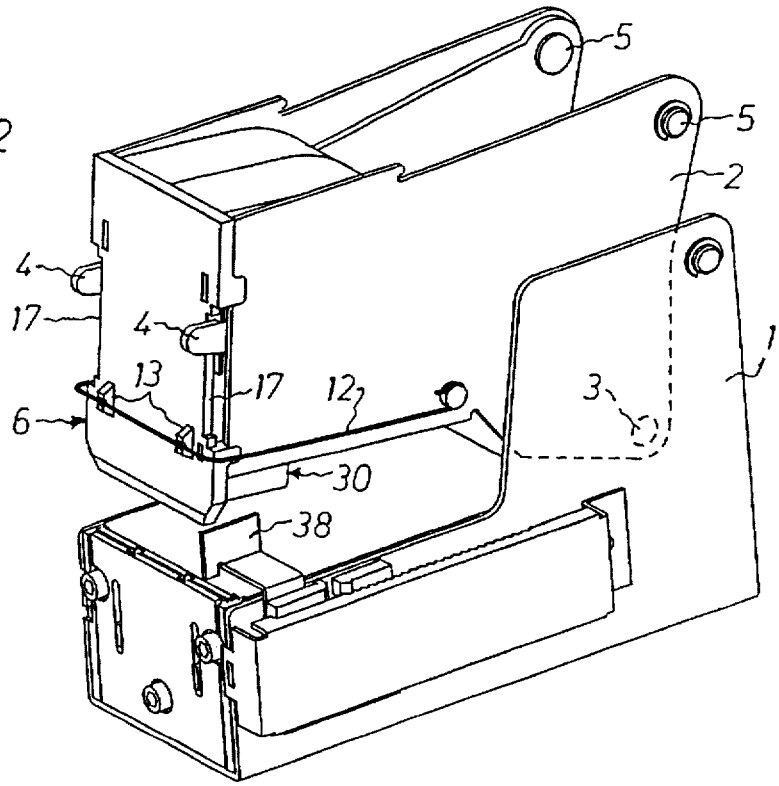
FIG. 2 is a perspective view of the stapler with the cassette inserted therein.

The stapler illustrated in FIGS. 1 and 2 is electrically operated and has a stationary base 1 and a stapler head 2 pivotably connected to the base 1. The stapler head 2 is pivotable about a transverse pin 3 and is shown, in FIGS. 1 and 2, in an upper starting position.

The stapler head 2 is a U-shaped channel in which is provided a drive mechanism in the form of two arms 4. At the rear end, the arms 4 are each pivotably connected to a side wall of the U-shaped channel. The arms 4 extend forward in parallel with the side walls and project, at the front end, a distance beyond the stapler head 2. The arms 4 are each pivotable about a transverse pivot pin 5. The pivot pins 5 are situated opposite to one another and in parallel with the pin 3. In FIGS. 1 and 2, the arms 4 are shown in an upper position.

Figure 3:
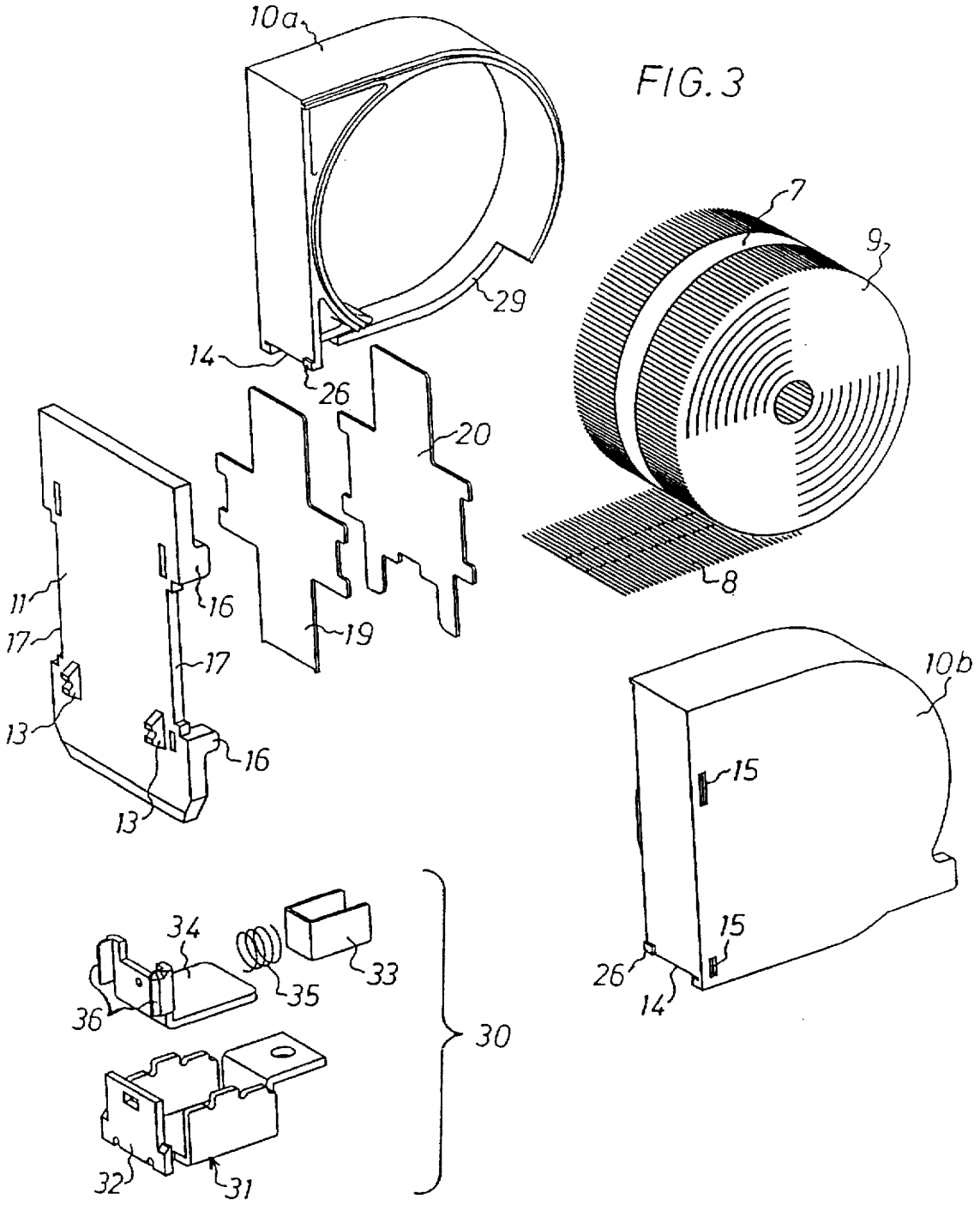
FIG. 3 is an exploded perspective view of the cassette and a mechanism cooperating therewith.
Figure 4:
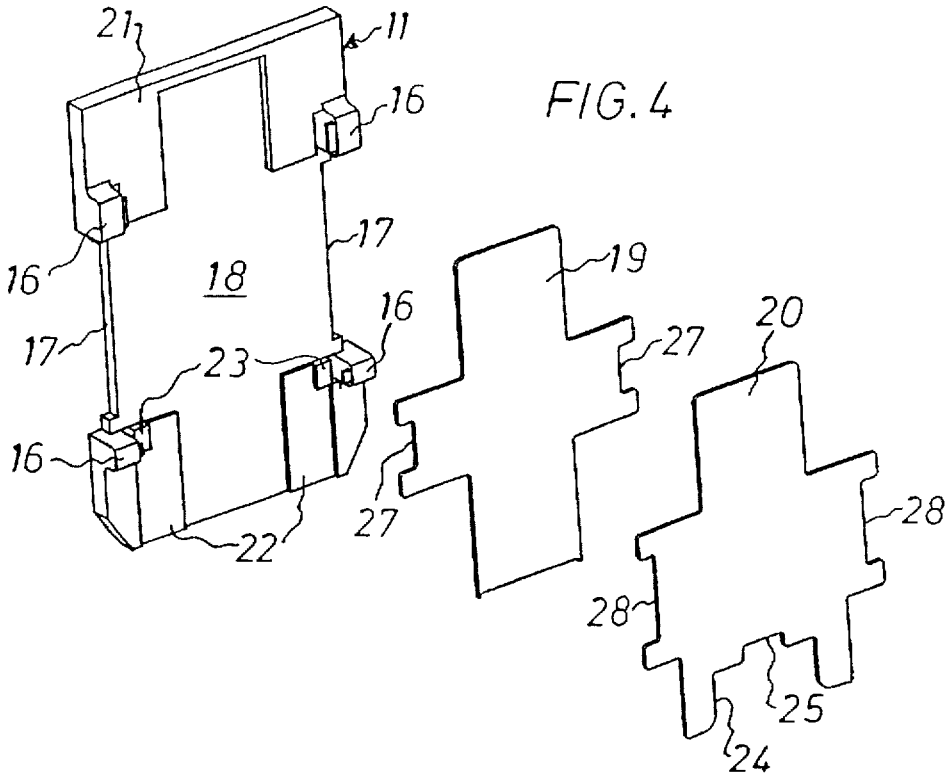
FIG. 4 is an exploded perspective view of the front plate of the cassette, a staple driver and a staple shaper.

With the stapler goes a cassette 6 containing straight wire staple blanks which are juxtaposed and releasably interconnected by a tape 7 so as to form a strip 8 of staple blanks, which is rolled up into a roll 9 (FIG. 3).

The cassette 6, which is made of plastics material, is composed of a casing 10 consisting of two essentially mirror-inverted halves 10*a* and 10*b* and a front plate 11 connected to the casing 10. The cassette 6 can be inserted in the stapler head 2, as illustrated in FIG. 2. When inserted, the cassette 6 is kept in place by a pivotable spring clip 12 pivotably attached to the stapler head 2 and engaging grooves provided in two lugs 13 on the outside of the front plate 11.

When assembled, the two halves 10*a* and 10*b* form a casing 10 having a cylindrical inner chamber for the strip roll 9. In its lower portion, the casing 10 has a front opening 14 for discharging the strip 8. Both halves 10*a* and 10*b* have two external lateral recesses 15 in the front portion. The front plate 11, which is of essentially rectangular shape, has, at each of its two vertical long-side edges, two lugs 16 with inwardly-directed projecting portions engaging the lateral recesses 15 of the halves 10*a* and 10*b* when the cassette 16 is completely assembled, as illustrated in FIG. 1. Then, the front plate 11 holds the two halves 10*a* and 10*b* together. To this end, use is conveniently also made of a tape (not shown), which is applied at least along a certain distance of the joint between the two halves.

In each of the vertical long-side edges, the front plate 11 has a recess 17 extending between the two lugs 16 to permit the projecting portion of the arm 4 to pass. The recesses 17 have such a vertical extent as to permit the arms 4 to pivot (see FIG. 2).

Figure 5:
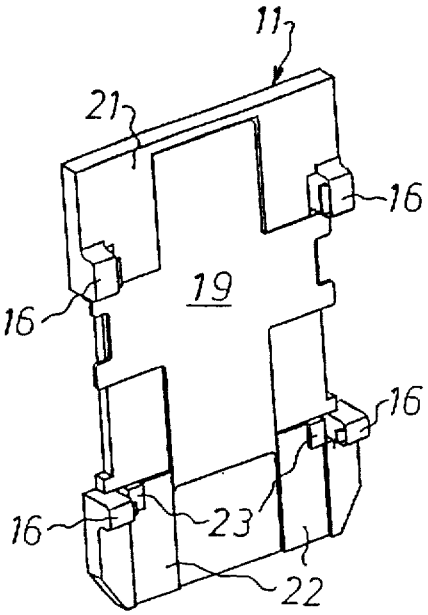
FIG. 5 is a perspective view of the front plate with the staple driver provided therein.
Figure 6:
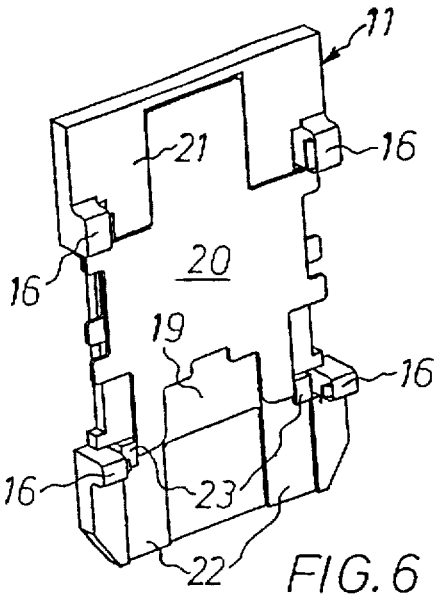
FIG. 6 is a perspective view of the front plate with the staple driver and the staple shaper provided therein.

In the inner side, i.e. the side facing the casing 10, the front plate 11 has a cruciform recess 18. The two horizontal portions and the lower vertical portion of the cruciform recess 18 extend up to the edges of the front plate 11, while the upper vertical portion ends at a distance inwardly of the upper horizontal edge of the front plate 11. The cruciform recess 18 serves to receive and guide a staple driver 19 and a staple shaper 20, which consist of substantially cruciform thin metal sheets. The portion 21 of the front plate 11 that defines the cruciform recess 18 upwardly is thicker than the plate portion 22 that defines the lower part of the recess. The thinner portion 22 has such a thickness as to be located on the same level as the staple driver 19 when this is inserted in the recess 18 (FIG. 5). The thicker portion 21 is located on the same level as the staple shaper 20 when this is inserted in the recess 18 on top of the staple driver 19 (FIG. 6). The thinner portion 22 has two lugs 23 located one on each side of the lower vertical portion of the recess 18 and projecting to the same level as the thicker portion 21. The difference in level between the bottom of the recess 18 and the thinner portion 22 equals the thickness of the wire staple blank.

The upper vertical arms of the substantially cruciform metal sheets 19 and 20 have the same width as the upper vertical portion of the cruciform recess 18 (see FIGS. 5 and 6), and the lower vertical arm of the metal sheet 19 has the same width as the lower vertical portion of the recess 18 (see FIG. 5). The lower vertical arm of the metal sheet 20, however, is much broader than the lower vertical portion of the recess 18 (see FIG. 6). The lower vertical arm of the metal sheet 20, whose width equals the distance between the two lugs 23, has, at its lower edge, a rectangular recess 24 of the same width as the lower vertical portion of the cruciform recess 18 (see FIG. 6). At the bottom, the rectangular recess 24 has a smaller rectangular recess 25 adapted to receive, when the metal sheet 20 is displaced downwardly, a stop lug 26 which is provided just above the front opening 14 of the casing 10 and whose function will be described in more detail below. At the outer end, the two horizontal arms of the metal sheet 19 have a rectangular recess 27 whose width, i.e. vertical extent, equals the vertical extent of the respective arms 4 in the projecting portion received in the recess 27 when the cassette 6 is inserted in the stapler head 2 (FIG. 2). At the outer end, the two horizontal arms of the metal sheet 20 have a rectangular recess 28 of much larger width, i.e. vertical extent, than the corresponding recess 27 in the metal sheet 19. The projecting portions of the arms 4 are received in the recesses 28 of the metal sheet 20 when the cassette 6 is inserted in the stapler head 2 (FIG. 2).

Figure 7:
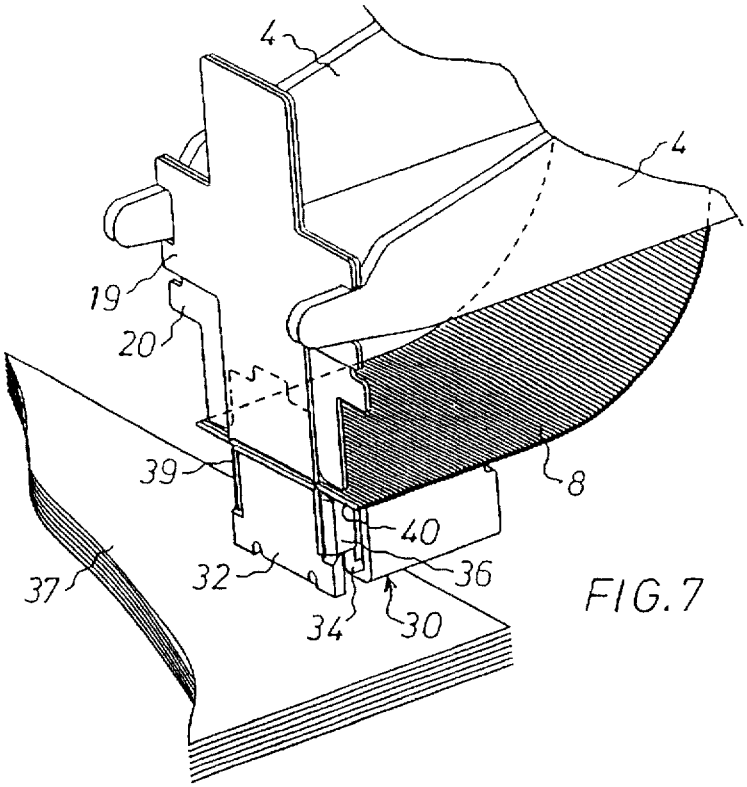
FIGS. 7–10 are schematic perspective views illustrating the function of the stapler equipped with the inventive cassette.

In FIG. 6, the staple driver 19 and the staple shaper 20 are shown in the starting position, in which they are held by the arms 4 in the manner shown in FIG. 7 and in which the horizontal arms of the staple driver 19 and the staple shaper 20 are applied against the portion 21.

As appears from the foregoing, the cassette 6 contains the staple driver 19 as well as the staple shaper 20, which both constitute wearing components in a heavily-used stapler. Thus, the components 19 and 20 are replaced in a particularly simple way each time the cassette is replaced.

Naturally, the cassette is replaced when the strip 8 of staple blanks has been used up. Each half 10*a* and 10*b* of the casing has a recess 29. When the halves 10*a* and 10*b* are joined together, the recesses 29 form an opening through which it is possible to sense, with the aid of a suitable means (not shown), when the tail end of the strip 8 passes the opening and the cassette 6 thus should be replaced.

A mechanism 30 for cooperating with the staple driver 19 and the staple shaper 20 is fixed to the stapler head 2 in the front portion, as appears most clearly from FIG. 1. The mechanism 30 consists of a box-like element 31, whose front wall 32 forms a die on which the staple blanks are formed into U-shaped staples, a spring seat 33, a feeding element 34 and a spring 35. The spring seat 33 is provided in the rear portion of the box-like element 31, while the feeding element 34 is provided in the front portion. The spring 35 is arranged between the spring seat 33 and the feeding element 34 so as to push the latter forwards. The feeding element 34 is substantially L-shaped and has a front leg which is directed vertically upwards and which has two feeders 36 projecting forwards in the form of vertical ribs extending up to the front surface of the front wall 32. Each rib 36 has an upper bevelled surface, located on a level with the flat horizontal upper surface of the front wall 32, as well as a front bevelled surface.

The function of the stapler will now be described in more detail with reference to FIGS. 7–10.

Figure 10:
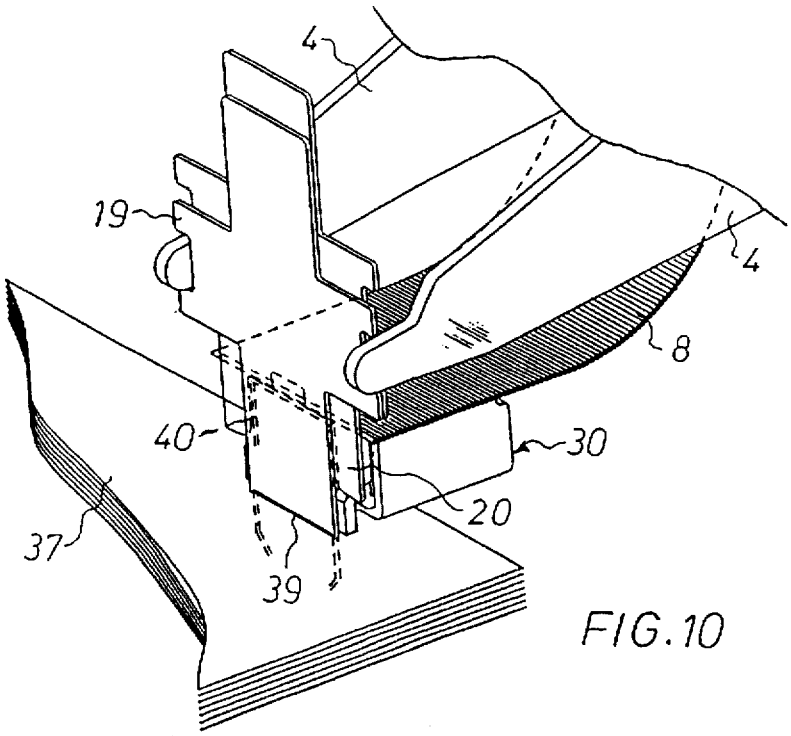

As mentioned before, the illustrated stapler is electrically operated, and is driven by an electric motor (not shown) which, via a transmission mechanism (not shown), pivots the arms 4 between an upper starting position (shown in FIGS. 1, 2 and 7) and a lower turning position (shown in FIG. 10).

When the stapler head 2 is in the upper starting position (FIGS. 1 and 2), a sheaf of papers 37 is placed in the stapler between the base 1 and the stapler head 2. A microswitch 38 is then actuated and starts the motor. Then, the motor first pivots the stapler head 2 down to a position in which the mechanism 30 is applied against the sheaf of papers 37 (see FIGS. 7–10).

Thereafter, the motor pivots the arms 4 downwards from the starting position, in which they hold the staple driver 19 and the staple shaper 20 in the starting position (FIG. 6), as mentioned before. In the position shown in FIG. 7, the feeding element 34 pushes the first staple blank 39, which has already been bent into a U-shaped staple, so that it is applied against the bottom of the lower vertical portion of the cruciform recess 18. Then, the two feeders 36 of the feeding element 34 are each pressed against a leg of the staple 39. In the position shown in FIG. 7, the second staple blank 40 is located straight above the front wall or die 32. The staple driver 19 and the staple shaper 20 are situated straight above, respectively, the first staple blank or staple 39 and the second staple blank 40. When pivoted downwards from the starting position, the arms 4 entrain the staple driver 19, which thus releases from the strip 8 the blank 39 formed into a U-shaped staple, and drives it downwards.

When the free leg ends of the staple 39 reach the sheaf of papers 37 (FIG. 8), the arms 4 are applied against the lower defining edge of the respective recesses 28 in the staple shaper 20, which thus is entrained when the arms 4 are further pivoted downwards.

Figure 8:
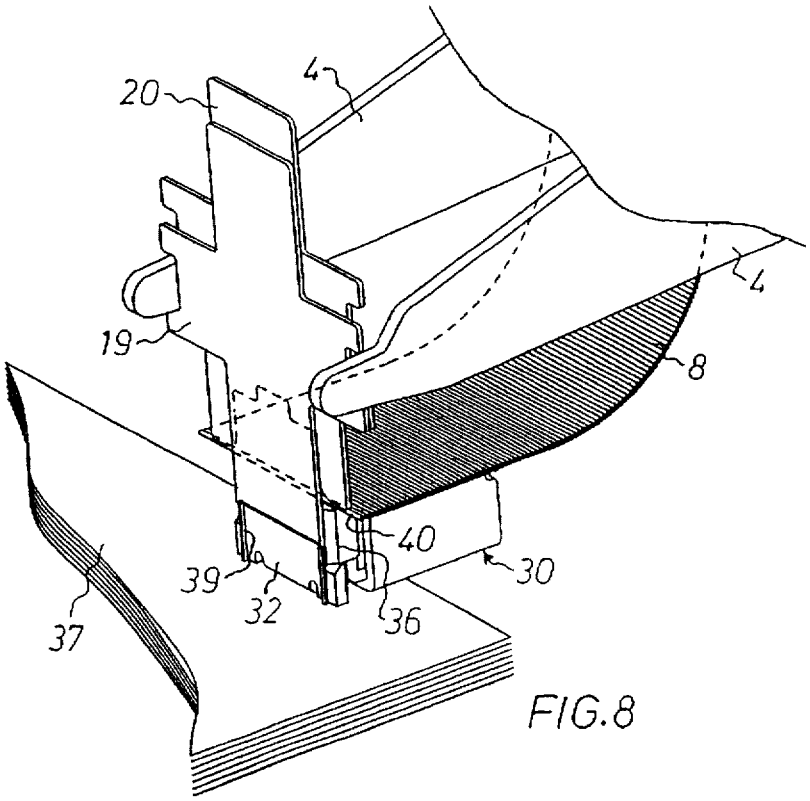
Figure 9:
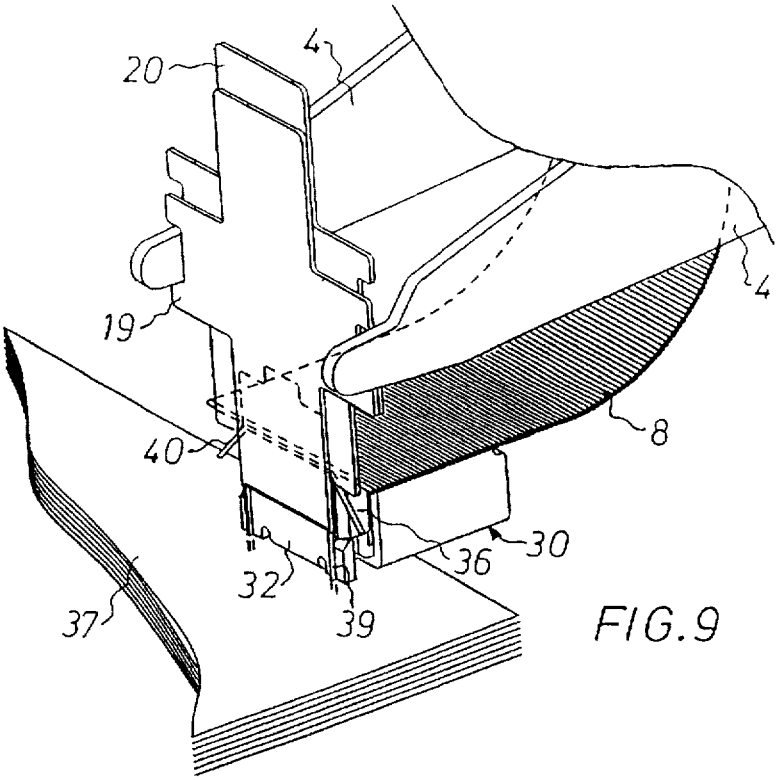

When the arms 4 are pivoted further downwards from the position shown in FIG. 8, the staple driver 19 drives the legs of the staple 39 through the sheaf of papers 37, at the same time as the staple shaper 20 bends the second staple blank 40 on the front wall or die 32 (see FIG. 9). While the blank 40 is thus bent, the feeding element 34 is pushed rearwards owing to the fact that those parts of the blank 40 that are being bent to form the legs of the finished U-shaped staple are pressed against the bevelled surfaces of the respective feeders 36.

When the arms 4 have reached the lower position (FIG. 10), the staple driver 19 has driven the staple 39 into the sheets of paper and the staple shaper 20 has bent the staple blank 40 into a finished U-shaped staple.

At the same time as the staple 39 is driven into the sheaf of papers 37, its legs are bent towards one another with the aid of a clinching mechanism (not described in detail here or shown) which completes the bending of the legs which thus are applied against the underside of the sheaf of papers 37 after the position shown in FIG. 10 has been reached. Then, the arms 4 are swung back to the starting position.

When swung back to the upper position, the arms 4 entrain the staple driver 19 and the staple shaper 20 to the starting position. The stop lug 26 provided on the casing 10 prevents the newly-shaped staple 40 from accompanying the staple shaper 20 when moved upwards. When the staple driver 19 and the staple shaper 20 have reached the starting position, the strip 8 is advanced one step by the feeding element 34 pushing the staple 40 into engagement against the bottom of the lower vertical portion of the cruciform recess 18. The stapling cycle is thus completed.

As is evident, the area where staples may get stuck in the stapler is exposed when the cassette 6 is removed, so that a stoppage caused by a stuck staple is easily taken care of.

It goes without saying that the cassette may be modified in various ways within the scope of the invention as defined in the appended claims. For instance, the cassette may thus contain, instead of a staple strip rolled up into a roll, a plurality of short strips stacked in the form of plates.

I claim:

1. A self-contained, replaceable cassette for use in a stapler, said stapler having a base, a stapler head with a frame that is configured to receive the cassette and that is constructed and supported to move relatively toward and away from the base in a stapling operation, and a drive mechanism for reciprocating a staple shaper and a staple driver, said cassette comprising:

a casing containing juxtaposed staple blanks releasably interconnected to form at least one strip of staple blanks;

a reciprocating staple shaper supported on the casing and disposed to successively shape the staple blanks of the strip into substantially U-shaped staples; and a reciprocating staple driver supported on the casing and disposed to successively release the staples from the strip and drive the staples into an object, the cassette having portions constructed and disposed to cooperate with the frame of the stapler head, such that the cassette, including the casing, the staple shaper, and the staple driver, is mountable and removable as a unit to and from the frame of the stapler head at a position where the staple shaper and the staple driver can be reciprocated by the drive mechanism of the stapler.

2. The cassette of claim 1, wherein the staple blanks are wires.

3. The cassette of claim 1, wherein the staple driver is displaced from the staple shaper along a direction of feeding the staple blanks, and wherein the staple shaper and the staple driver are constructed and disposed such that the staple driver drives a staple while the staple shaper shapes a subsequent staple blank.

4. The cassette of claim 1, wherein the staple shaper is disposed to cooperate with a die on the stapler head to shape the staple blanks.

5. The cassette of claim 1, wherein the casing has a front opening for discharging the staple blanks, the cassette further comprising a front wall supported on the casing and having a portion opposed to the front opening along a direction of feeding the staple blanks, the staple shaper and the staple driver being disposed between the front wall and the casing.

6. The cassette of claim 1, further comprising a front wall having guide portions that guide at least one of the staple shaper and the staple driver.

7. The cassette of claim 6, wherein the front wall has positioning surfaces that cooperate with corresponding surfaces on the stapler head to position the cassette relative to the stapler head.

8. The cassette of claim 6, wherein the casing has a front opening for discharging the staple blanks, the front wall is attached to the casing and has a portion opposed to the front opening along a direction of feeding the staple blanks, and the guide portions are located on a side of the front wall that faces the casing.

9. The cassette of claim 8, wherein the front wall is releasably attached to the casing.

10. The cassette of claim 6, wherein the guide portions guide both the staple shaper and the staple driver.

11. The cassette of claim 10, wherein the front wall includes recesses, and the staple shaper and the staple driver include projections that project through the recesses and that engage the drive mechanism when the cassette is mounted to the stapler head.

12. The cassette of claim 10, wherein the staple shaper and the staple driver are each substantially cruciform, and the front wall has a substantially cruciform recess that receives the staple shaper and the staple driver.

13. A self-contained, replaceable cassette for use in a stapler, the stapler having a base, a stapler head with a frame that is configured to receive the cassette and that is constructed and supported to move relatively toward and away from the base in a stapling operation, and a drive mechanism for reciprocating a staple shaper and a staple driver, said cassette comprising:

a casing containing juxtaposed staple blanks releasably interconnected to form at least one strip of staple blanks;

a reciprocating staple shaper supported on the casing and disposed to successively shape the staple blanks of the strip into substantially U-shaped staples; and a reciprocating staple driver supported on the casing and disposed to successively release the staples from the strip and drive the staples into an object, the staple driver being displaced from the staple shaper along a direction of feeding the staple blanks, the staple shaper and the staple driver being constructed and disposed such that the staple driver drives a staple while the staple shaper shapes a subsequent staple blank.

the cassette having portions constructed and disposed to cooperate with the frame of the stapler head, such that the cassette, including the casing, the staple shaper, and the staple driver, is mountable and removable as a unit to and from the frame of the stapler head at a position where the staple shaper and the staple driver can be reciprocated by the drive mechanism of the stapler.

14. The cassette of claim 13, wherein the staple shaper is disposed to cooperate with a die on the stapler head to shape the staple blanks.

15. The cassette of claim 13, wherein the staple blanks are wires.

16. The cassette of claim 13, wherein the casing has a front opening for discharging the staple blanks, the cassette further comprising a front wall supported on the casing and having a portion opposed to the front opening along the direction of feeding the staple blanks, the staple shaper and the staple driver being disposed between the front wall and the casing.

17. The cassette of claim 13, further comprising a front wall having guide portions that guide at least one of the staple shaper and the staple driver.

18. The cassette of claim 17, wherein the front wall has positioning surfaces that cooperate with corresponding surfaces on the stapler head to position the cassette relative to the stapler head.

19. The cassette of claim 17, wherein the casing has a front opening for discharging the staple blanks, the front wall is supported on the casing and has a portion opposed to the front opening along the direction of feeding the staple blanks, and the guide portions are located on a side of the front wall that faces the casing.

20. The cassette of claim 17, wherein the guide portions guide both the staple shaper and the staple driver.

21. The cassette of claim 20, wherein the staple shaper and the staple driver are each substantially cruciform, and the front wall has a substantially cruciform recess that receives the staple shaper and the staple driver.

22. The cassette of claim 20, wherein the front wall includes recesses, and the staple shaper and the staple driver include projections that project through the recesses and that engage the drive mechanism when the cassette is mounted to the stapler head.

23. A self-contained, replaceable cassette for use in a stapler, the stapler having a base, a stapler head with a frame that is configured to receive the cassette and that is constructed to move relatively toward and away from the base in a stapling operation, and a drive mechanism for reciprocating a staple shaper and a staple driver, said cassette comprising:

a casing containing juxtaposed staple blanks releasably interconnected to form at least one strip of staple blanks, the casing having a front opening for discharging the staple blanks;

a reciprocating staple shaper supported on the casing and disposed to successively shape the staple blanks of the strip into substantially U-shaped staples;

a reciprocating staple driver supported on the casing and disposed to successively release the staples from the strip and drive the staples into an object; and a front wall supported on the casing and having a portion opposed to the front opening along a direction of feeding the staple blanks, the staple shaper and the staple driver being disposed between the front wall and the casing, the cassette having portions constructed and disposed to cooperate with the frame of the stapler head, such that the cassette, including the casing, the stapler shaper, the staple driver, and the front wall, is mountable and removable as a unit to and from the frame of the stapler head at a position where the staple shaper and the staple driver can be reciprocated by the drive mechanism of the stapler.

24. The cassette of claim 23, wherein the staple shaper is disposed to cooperate with a die on the stapler head to shape the staple blanks.

25. The cassette of claim 23, wherein the staple blanks are wires.

26. The cassette of claim 23, wherein the front wall has positioning surfaces that cooperate with corresponding surfaces on the stapler head to position the cassette relative to the stapler head.

27. The cassette of claim 23, wherein the front wall has guide portions that guide at least one of the staple shaper and the staple driver.

28. The cassette of claim 27, wherein the guide portions are located on a side of the front wall that faces the casing.

29. The cassette of claim 27, wherein the guide portions guide both the staple shaper and the staple driver.

30. The cassette of claim 29, wherein the staple shaper and the staple driver are each substantially cruciform, and the front wall has a substantially cruciform recess that receives the staple shaper and the staple driver.

31. The cassette of claim 29, wherein the front wall includes recesses, and the staple shaper and the staple driver include projections that project through the recessed and that engage the drive mechanism when the cassette is mounted to the stapler head.

32. A stapling apparatus comprising:

a stapler including a base, a stapler head with a frame that is constructed and supported to move relatively toward and away from the base in a stapling operation, and a drive mechanism for reciprocating a staple shaper and a staple driver; and a self-contained, replaceable staple cassette including juxtaposed staple blanks releasably interconnected to form at least one strip of staple blanks, a reciprocating staple shaper disposed to successively shape the staple blanks of the strip into substantially U-shaped staples, and a reciprocating staple driver disposed to successively release the staples from the strip and drive the staples into the object, the cassette having portions disposed to cooperate with the frame of the stapler head, such that the cassette is mountable and removable as a unit to and from the frame of the stapler head at a position where the staple shaper and the staple driver can be reciprocated by the drive mechanism of the stapler.

33. The stapling apparatus of claim 32, wherein the stapler head has a die, and the staple shaper cooperates with the die to shape the staple blanks.

34. The stapling apparatus of claim 32, wherein the staple blanks are wires.

35. The stapling apparatus of claim 32, wherein the staple driver is displaced from the staple shaper along a direction of feeding the staple blanks, and wherein the staple shaper and the staple driver are constructed and disposed such that the staple driver drives a staple while the staple shaper shapes a subsequent staple blank.

36. The stapling apparatus of claim 32, wherein the cassette further includes a casing containing the strip and having a front opening for discharging the staple blanks, and a front wall attached to the casing and having a portion opposed to the front opening along a direction of feeding the staple blanks, the staple shaper and the staple driver being disposed between the front wall and the casing.

37. The stapling apparatus of claim 32, wherein the cassette further includes a front wall having guide portions that guide at least one of the staple shaper and the staple driver.

38. The stapling apparatus of claim 37, wherein the front wall has positioning surfaces that cooperate with corresponding surfaces on the stapler head to position the cassette relative to the stapler head.

39. The stapling apparatus of claim 37, wherein the cassette further includes a casing containing the strip and having a front opening for discharging the staple blanks, and wherein the front wall is attached to the casing and has a portion opposed to the front opening along a direction of feeding the staple blanks, and the guide portions are located on a side of the front wall that faces the casing.

40. The stapling apparatus of claim 37, wherein the guide portions guide both the staple shaper and the staple driver.

41. The stapling apparatus of claim 40, wherein the staple shaper and the staple driver are each substantially cruciform, and the front wall has a substantially cruciform recess that receives the staple shaper and the staple driver.

42. The stapling apparatus of claim 40, wherein the front wall includes recesses, and the staple shaper and the staple driver include projections that project through the recesses and that engage the drive mechanism when the cassette is mounted to the stapler head.

43. A stapling apparatus comprising:

a stapler including a base, a stapler head with a frame that is constructed and supported to move relatively toward and away from the base in a stapling operation, and a drive mechanism for reciprocating a staple shaper and a staple driver; and a self-contained, replaceable staple cassette including juxtaposed staple blanks releasably interconnected to form at least one strip of staple blanks, a reciprocating staple shaper disposed to successively shape the staple blanks of the strip into substantially U-shaped staples, and a reciprocating staple driver disposed to successively release the staples from the strip and drive the staples into the object, the staple driver being displaced from the staple shaper along a direction of feeding the staple blanks, the staple shaper and the staple driver being constructed and disposed such that the staple driver drives a staple while the staple shaper shapes a subsequent staple blank, the cassette having portions constructed and disposed to cooperate with the stapler head, such that the cassette is mountable and removable as a unit to and from the frame of the stapler head at a position where the staple shaper and the staple driver can be reciprocated by the drive mechanism of the stapler.

44. The stapling apparatus of claim 43, wherein the stapler head has a die, and the staple shaper cooperates with the die to shape the staple blanks.

45. The stapling apparatus of claim 43, wherein the staple blanks are wires.

46. The stapling apparatus of claim 43, wherein the cassette further includes a casing containing the strip and having a front opening for discharging the staple blanks, and a front wall attached to the casing and having a portion opposed to the front opening along the direction of feeding the staple blanks, the staple shaper and staple driver being disposed between the front wall and the casing.

47. The stapling apparatus of claim 43, wherein the cassette further includes a front wall having guide portions that guide at least one of the staple shaper and the staple driver.

48. The stapling apparatus of claim 47, wherein the front wall has positioning surfaces that cooperate with corresponding surfaces on the stapler head to position the cassette relative to the stapler head.

49. The stapling apparatus of claim 47, wherein the cassette further includes a casing containing the strip and having a front opening for discharging the staple blanks, and wherein the front wall is attached to the casing and has a portion opposed to the front opening along the direction of feeding the staple blanks, and the guide portions are located on a side of the front wall that faces the casing.

50. The stapling apparatus of claim 47, wherein the guide portions guide both the staple shaper and the staple driver.

51. The stapling apparatus of claim 50, wherein the staple shaper and the staple driver are each substantially cruciform, and the front wall has a substantially cruciform recess that receives the staple shaper and the staple driver.

52. The stapling apparatus of claim 50, wherein the front wall includes recesses, and the staple shaper and the staple driver include projections that project through the recesses and that engage the drive mechanism when the cassette is mounted to the stapler head.

53. A stapling apparatus comprising:

a stapler including a base, a stapler head with a frame that is constructed and supported to move relatively toward and away from the base in a stapling operation, and a drive mechanism for reciprocating a staple shaper and a staple driver; and a self-contained, replaceable staple cassette including juxtaposed staple blanks releasably interconnected to form at least one strip of staple blanks, a reciprocating staple shaper disposed to successively shape the staple blanks of the strip into substantially U-shaped staples, a reciprocating staple driver disposed to successively release the staples from the strip and drive the staples into an object, a casing containing the strip and having a front opening for discharging the staple blanks, and a front wall attached to the casing and having a portion opposed to the front opening along a direction of feeding the staple blanks, the staple shaper and the staple driver being disposed between the front wall and the casing, the cassette having portions constructed and disposed to cooperate with the stapler head, such that the cassette is mountable and removable as a unit to and from the frame of the stapler head at a position where the staple shaper and the staple driver can be reciprocated by the drive mechanism of the stapler.

54. The stapling apparatus of claim 53, wherein the stapler head has a die, and the staple shaper is disposed to cooperate with the die to shape the staple blanks.

55. The stapling apparatus of claim 53, wherein the staple blanks are wires.

56. The stapling apparatus of claim 53, wherein the front wall has positioning surfaces that cooperate with corresponding surfaces on the stapler head to position the cassette relative to the stapler head.

57. The stapling apparatus of claim 53, wherein the front wall has guide portions that guide at least one of the staple shaper and the staple driver.

58. The stapling apparatus of claim 57, wherein the guide portions are located on a side of the front wall that faces the casing.

59. The stapling apparatus of claim 57, wherein the guide portions guide both the staple shaper and the staple driver.

60. The stapling apparatus of claim 59, wherein the staple shaper and the staple driver are each substantially cruciform, and the front wall has a substantially cruciform recess that receives the staple shaper and the staple driver.

61. The stapling apparatus of claim 59, wherein the front wall includes recesses, and the staple shaper and the staple driver include projections that project through the recesses and that engage the drive mechanism when the cassette is mounted to the stapler head.

* * * * *

UNITED STATES PATENT AND TRADEMARK OFFICE

CERTIFICATE OF CORRECTION

PATENT NO. : 5,794,833
DATED : August 18, 1998
INVENTOR(S) : Olle STRAAT

It is certified that error appears in the above-identified patent and that said Letters Patent is hereby corrected as shown below:

On the title page:

Delete "[22] Filed: Oct. 6, 1994 and insert the following in place thereof:

--[22] PCT Filed: Feb. 26, 1993

[86] PCT No.: PCT/SE93/00165

§ 371 Date: Oct. 6, 1994
§ 102(e) Date: Oct. 6, 1994

[87] PCT Pub. No.: WO 93/20977
PCT Pub. Date: Oct. 28, 1993--.

Signed and Sealed this

Fifteenth Day of December, 1998

Bruce Lehman

*Attest:*

BRUCE LEHMAN

*Attesting Officer*

*Commissioner of Patents and Trademarks*